United States Patent [19]

Draugelis et al.

[11] 4,102,681

[45] Jul. 25, 1978

[54] TRANSFER AND FUSING METHOD

[75] Inventors: Vaidevutis C. Draugelis; George N. Tsilibes; John E. Vineski, all of Rochester, N.Y.

[73] Assignee: Xerox Corporation, Stamford, Conn.

[21] Appl. No.: 455,701

[22] Filed: Mar. 28, 1974

Related U.S. Application Data

[62] Division of Ser. No. 300,531, Oct. 25, 1972, Pat. No. 3,826,892.

[51] Int. Cl.[2] ..... G03G 13/20; G03G 13/22

[52] U.S. Cl. ..... 96/1.4; 96/1 R; 355/3 R; 427/22

[58] Field of Search ..... 96/1.4, 1 R; 219/216; 355/3 R

[56] References Cited

U.S. PATENT DOCUMENTS

| | | | |
|---|---|---|---|
| 3,444,354 | 5/1969 | Mindell | 219/216 |
| 3,517,164 | 6/1970 | Huggins et al. | 219/216 |
| 3,584,195 | 6/1971 | Vince | 219/216 |
| 3,687,541 | 8/1972 | Aser et al. | 96/1.4 |
| 3,697,722 | 10/1972 | Furuichi et al. | 219/216 |
| 3,697,726 | 10/1972 | Geronime | 219/216 |
| 3,748,088 | 7/1973 | Mooney et al. | 219/216 |
| 3,772,497 | 11/1973 | Gray et al. | 355/3 R |

*Primary Examiner*—Roland E. Martin, Jr.
*Attorney, Agent, or Firm*—J. J. Ralabate; C. A. Green; H. Fleischer

[57] ABSTRACT

An apparatus in which a powder pattern deposited on a support material is permanently affixed thereto. The support material is heated during the movement thereof into thermal communication with a radiant energy output. In this manner, the powder pattern is coalesced and fixed permanently to the support material.

3 Claims, 6 Drawing Figures

TRANSFER AND FUSING METHOD

This is a division of application Ser. No. 300,531, filed Oct. 25, 1972, now U.S. Pat. No. 3,826,892.

The foregoing abstract is neither intended to define the invention disclosed in the specification, nor is it intended to be limiting as to the scope of the invention in any way.

BACKGROUND OF THE INVENTION

This invention relates generally to an electrophotographic printing machine, and more particularly concerns an apparatus for coalescing and affixing permanently a powder pattern to a support material in image configuration.

In the process of electrophotographic printing, a charged photoconductive member is exposed to a light image of an original document to be reproduced for recording thereon an electrostatic latent image. A development system, thereupon, moves a developer mix of carrier granules and toner paticles, into contact with the photoconductive member. Toner particles are attracted electrostatically to the latent image forming a toner powder image thereon. The toner powder image is, then, transferred to the sheet of support material.

Multi-color printing repeats the foregoing process a plurality of cycles. Each development cycle deposits differently colored toner particles on the support material, in superimposed registration with the previously deposited toner particles. Hence, the support material will have transferred thereto various layers of toner particles forming a multi-layered powder image. The powdered layers have to coalesce and become transparent, i.e. each toner layer modulates the light rays passing therethrough, to form a copy having a single composite color. In this manner, the modulated light rays transmitted through the toner powder layers are reflected from the support material back through the toner powder to the eye of the observer. If the toner layers do not become transparent, the color reproduced will merely be that of the uppermost layer of toner particles. It is apparent that the fusing operation must coalesce the toner particles and form transparent layers thereof to appropriately modulate the light rays transmitted therethrough creating a copy having the composite color of the original document.

Generally, the toner particles include, primarily, fusible resins. When such toner particles are transferred to the support material, the powder image can be permanently affixed thereto by heating which partially dissolves the toner particles causing them to fuse into the support material. Conventional black and white electrophotographic printing machines utilize fusers which heat the toner paticles sufficiently to fix them to the support material, while not charring or igniting the support material. Heretofore, there was little concern with coalescing multi-layers of toner particles. Thus, it is apparent that the requirement for coalescing multi-layers of toner particles adds but one more variable in an already complex system.

Preferably, it is desirable to raise the temperature of the support material so that it is close to the fusing temperature of the toner particles. In this way, the support material acts as a heat source rather than a heat sink during the fusing operation. Thus, a suitable fusing apparatus may include heating the support material as well as applying radiant heat thereto to permanently affix and coalesce the toner powder image to the support material.

Heating of the support material prior to exposing the toner powder image to radiant energy has been disclosed in U.S. Pat. No. 3,187,162 issued to Toku Hojo et al. in 1965. As disclosed therein, the support material advances over a pre-heat platen which raises the temperature thereof by conduction. The fuser disclosed in the Hojo patent also includes an incandescent filament lamp arranged adjacent to and over the path of travel of the support material to emit radiant energy which assists in fusing the toner powder image to the support material.

In high speed electrophotographic printing machines, the utilization of a stationary pre-heat platen may pose a problem. A boundary layer of air frequently is developed between the rapidly moving support material and the pre-heat platen. This layer of air serves to insulate the support material from the pre-heat platen and introduces a variable in the actual temperature of the support material. The more rapidly the support material is moved over the platen, the greater the uncertainty in heating the support material to a pre-determined temperature. This is particularly significant when the support material is cut sheet paper, such as is used in conventional electrophotographic printing machines, rather than a web of paper passing over the pre-heat platen. The rapid movement of a relatively non-rigid sheet forces air between the heated platen and the sheet. Hence, the more rapidly the cut sheet of paper moves over the heat platen, the greater will be the boundary layer created thereby. In addition thereto, the radiant heater and the pre-heat platen must operate in conjunction with one another to coalesce and affix the multi-layer toner powder to the support material. This should be achieved without charring or igniting the support material. Precise temperature control of the support material is not readily attainable when a sheet of cut paper passes over a stationary platen forming a layer of air therebetween.

Accordingly, it is a primary object of the present invention to improve the fusing of single or multi-layered toner powder images to create a composite colored reproduction corresponding to the original colored document.

SUMMARY OF THE INVENTION

Briefly stated, and in accordance with the present invention, there is provided an apparatus for coalescing and affixing permanently a powder pattern to a support material.

In the preferred embodiment thereof, the apparatus includes transport means, heating means, and a radiant energy source. The transport means advances a sheet of support material with a powder pattern deposited on one surface thereof along a path of movement, the other surface of the support material being in substantial contact with the transport means. As the support material is advanced, heating means heat the transport means, which, in turn, heats the support material. Additional energy is supplied by the radiant energy source, the radiant energy source being in thermal communication with the support material advancing along the path of movement thereof.

BRIEF DESCRIPTION OF THE DRAWINGS

Other objects and advantages of the present invention will become apparent upon reading the following detailed description and upon reference to the drawings, in which.

Figure 1:
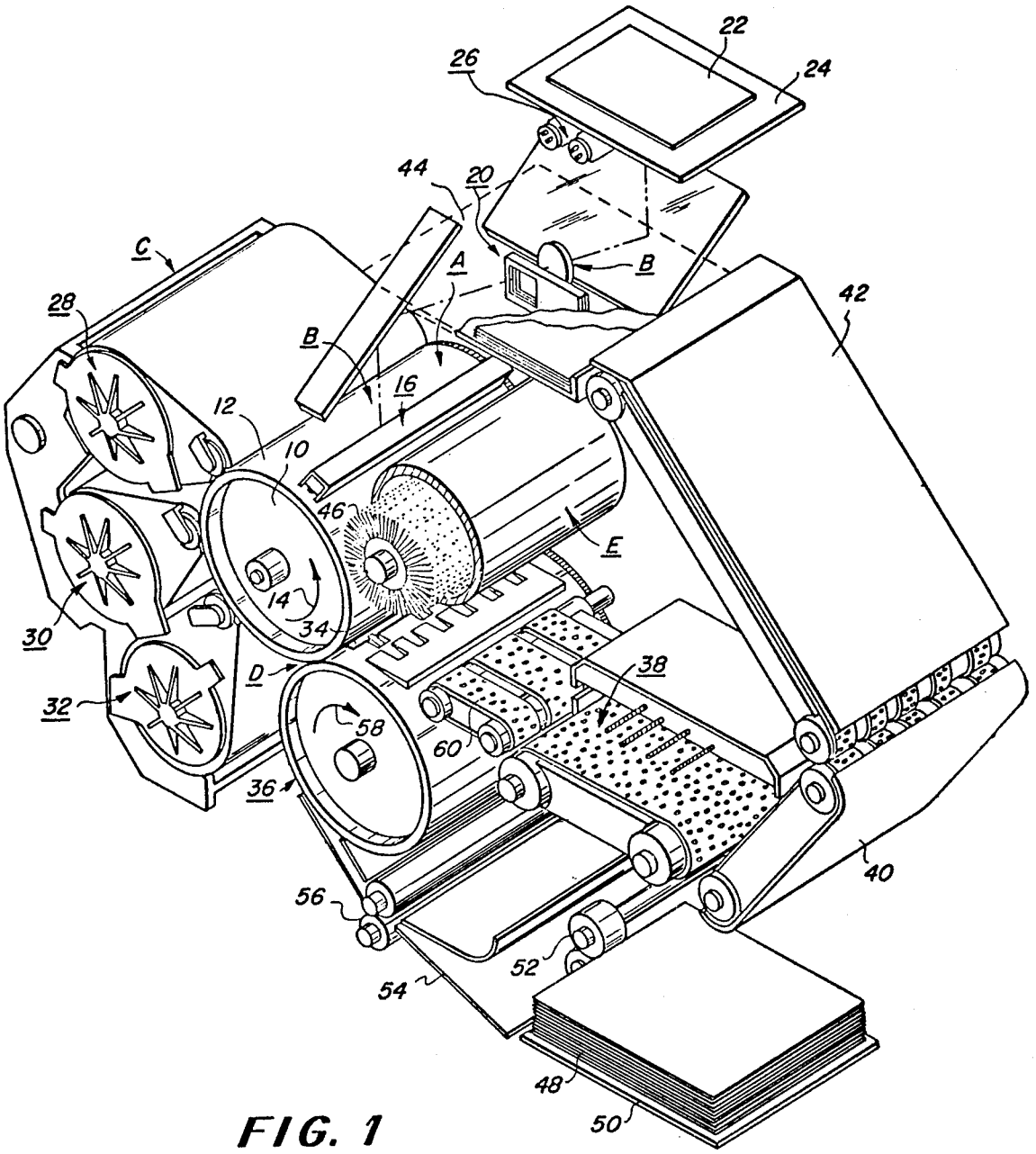
FIG. 1 is a schematic perspective view of an electrophotographic printing machine having the present invention therein.

While the present invention will be described in connection with a preferred embodiment and method of use thereof, it will be understood that it is not intended to limit the invention to that embodiment or method of use. On the contrary, it is intended to cover all alternatives, modifications and equivalents as may be included within the spirit and scope of the invention as defined by the appended claims.

DETAILED DESCRIPTION OF INVENTION

In an electrophotographic printing machine, very little time is available in which to coalesce and affix permanently a multi-layered powder image to a support material. The heat transfer must be rapidly and efficiently accomplished to obtain complete coalescence. Radiant heat transfer, in which infrared energy is emitted from a high temperature source, is an efficient source of energy which can be readily transferred to a support material having a multi-layered toner powder image deposited thereon.

An efficient radiator of infrared energy converts a high percentage of the internal energy available to radiant heat, and will concentrate this energy in a band of wavelengths located at the short end of the infrared spectrum. The support material is generally paper which absorbs a high percentage of infrared energy at wavelengths greater than 3.0 microns. At shorter wavelengths, the infrared energy absorption of the paper decreases rapidly. Infrared energy incident upon the toner powder image is rapidly converted to internal energy. However, if the temperature of the support material is lower than that of the toner powder image, the support material will act as a heat sink dissipating heat from the image areas. The heat energy transferred conductively from the toner powder image to the support material is dependent upon the temperature gradient therebetween. The magnitude of this heat transfer is critical, and may prevent the coalescence of the multi-layered toner powder image utilized in color electrophotographic printing. It, therefore, appears to be desirable to heat the support material minimizing any heat loss thereto. In the present invention, the support material is heated, in conjunction with, radiant energy being supplied thereto to coalesce the toner powder image. This will be explained in greater detail with reference to the drawings wherein like reference numerals have been used throughout to deisgnate like elements.

Turning now to the drawings, FIG. 1 schematically illustrates an electrophotographic printing machine arranged to produce multi-color copies from a color original. As shown therein the machine employs a photoconductive member having a rotatably mounted drum 10 with a photoconductive surface 12 thereon. Drum 10 rotates in the direction indicated by arrow 14 to move photoconductive surface 12 through a series of processing stations A through E, inclusive.

Initially, drum 10 rotates photoconductive surface 12 through charging station A which has a corona generating device, indicated generally by the reference numeral 16, positioned thereat. Preferably, corona generating device 16 extends transversely across photoconductive surface 12 and is arranged to charge surface 12 to a relatively high uniform potential. A suitable corona generating device is described in U.S. Pat. No. 2,778,946 issued to Mayo in 1957.

Charged photoconductive surface 12 next rotates to exposure station B wherein a moving lens system, indicated generally at 18, and a color filter mechanism, depicted generally at 20, are positioned. One type of moving lens system suitable for the electrophotographic printing machine of FIG. 1 is disclosed in U.S. Pat. No. 2,062,108 issued to Mayo in 1962. As illustrated in FIG. 1, a colored original document 22 is stationarily supported face down upon transparent viewing platen 24. In this manner, successive incremental areas of original document 22 are illuminated by a moving lamp assembly, indicated generally at 26. Lamp assembly 26 and lens system 18 are moved in a timed relation with drum 10 to produce a flowing light image of original document 22 on photoconductive surface 12. The resultant image produced on photoconductive surface 12 is termed an electrostatic latent image. The electrophotographic printing machine depicted in FIG. 1 is arranged to interpose selected colored filters in the optical path of lens 18 via filter mechanism 20. Preferably, filter mechanism 20 operates on the light rays transmitted through lens 18 to record an electrostatic latent image on photoconductive surface 12 corresponding to a preselected spectral region of the electromagnetic wave spectrum, i.e. a color separated electrostatic latent image. In this manner, an electrostatic latent image is produced on photoconductive surface 12 which corresponds to a single color of original document 22.

Subsequent to the recording of the color separated electrostatic latent image on photoconductive surface 12, drum 10 rotates to development station C having three individual developer units, generally indicated by the reference numerals 28, 30 and 32, respectively, located thereat. The developer units depicted in FIG. 1 are all magnetic brush type developer units. In a magnetic brush development system, a magnetizable developer mix having carrier granules and toner particles is continually brought through a directional flux field to form a brush of developer mix. A suitable development system utilizing a plurality of developer units is disclosed in copending application Ser. No. 255,259 filed in 1972. Development is achieved by contacting photoconductive surface 12 with the brush of developer mix. Developer units 28, 30 and 32, each apply toner particles corresponding to the complement of the color separated latent image recorded on photoconductive surface 12. For example, developer units 28 deposits cyan toner particles on a red filtered latent image, developer unit 30 deposits magenta toner particles on a green filtered latent image, and developer unit 32 deposits yellow toner particles on a blue filtered latent image. The aforementioned steps of depositing various color toner particles on the respective electrostatic latent images occurs sequentially rather than simultaneously.

After development, the toner powder image electrostatically adheres to photoconductive surface 12 and moves therewith to transfer station D. At transfer station D the powder image is transferred to a sheet of final support material 34 by means of a biased transfer roll, shown generally at 36. U.S. Pat. No. 3,612,677 issued to Langdon in 1972 discloses a suitable electrically biased transfer roll. Transfer roll 36 is biased electrically to a potential such that the magnitude and polarity thereof is sufficient to attract electrostatically the toner powder image from photoconductive surface 12 to support material 34. A single sheet of support material 34 is supported on transfer roll 36. Bias transfer roll 36 is arranged to recirculate the sheet of support material 34 in synchronism with the rotation of drum 10. In this manner, the toner powder images developed on photoconductive surface 12 are transferred, in superimposed registration, to sheet 34. Hence, it is apparent that in a multi-color electrophotographic printing of the type depicted in FIG. 1, the aforementioned steps of charging, exposing, developing and transfer are repeated for a plurality of color separated light images in order to form a composite picture of the original document corresponding in color thereto.

After the last transfer operaton, support sheet 34 is stripped from bias transfer roll 36. Conveyor 60 advances sheet 34 to a fuser, shown generally at 38, where the multi-layered toner powder image is coalesced and permanently affixed thereto. Fuser 38 will be discussed hereinafter in conjunction with FIGS. 2 through 6, inclusive, in greater detail. After the multi-layered tone powder image is coalesced to support material 34, endless conveyor belts 40 and 42 advance support material 34 to catch tray 44 for subsequent removal by the machine operator.

Cleaning station E is the last processing station in the direction of rotation of drum 10, as indicated by arrow 14. Cleaning station E has positioned thereat a rotatably mounted fibrous brush 46 which engages photoconductive surface 12 to remove residual toner particles remaining thereon after the transfer operation. Preferably, fibrous brush 46 is of the type described in U.S. Pat. No. 3,590,412 issued to Gerbasi in 1971.

It should be noted that support material 34 may be plain paper or a transparent thermoplastic sheet, amongst others, which is advanced from a stack 48 mounted on tray 50. Feed roll 52 separates and advances the uppermost sheet from stack 50 into a baffle arrangement 54. Baffle 54 guides the advancing sheet into the nip of a pair of register rolls which align the sheet and pass it therebetween such that it is releasably secured to bias transfer roll 36. Bias transfer roll 36 is arranged to rotate in the direction of arrow 58 moving support material 34, releasably secured thereto, in a recirculating path such that successive toner images are transferred thereto in superimposed registration with one another forming a multi-layered toner powder image.

Figure 2:
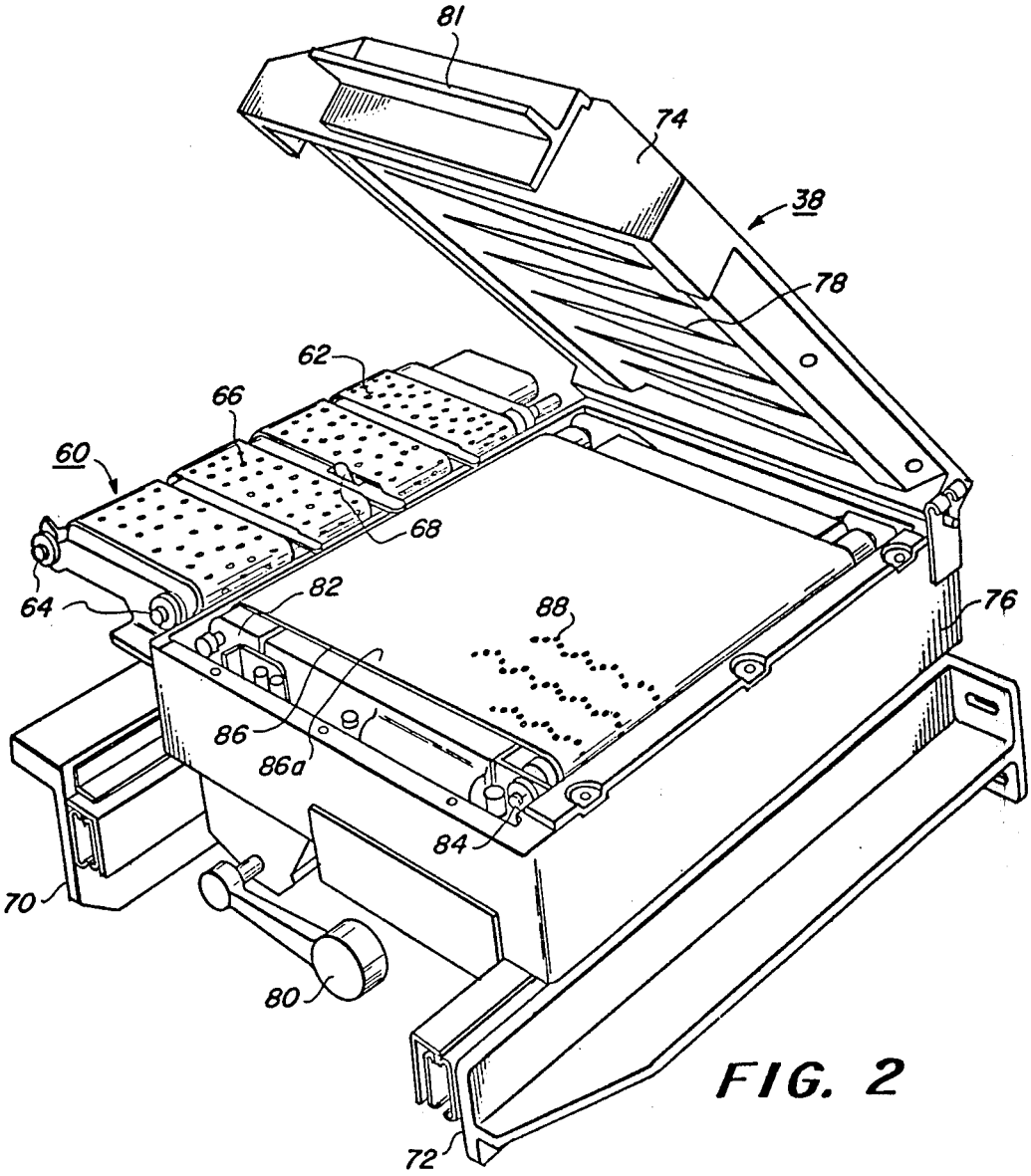
FIG. 2 is a perspective view of the fuser incorporated in the FIG. 1 printing machine with the cover pivoted to the opened position.

Referring now to FIG. 2, there is shown a perspective view of the fuser utilized in the electrophotographic printing machine of FIG. 1. The fuser is depicted in FIG. 2 as having the cover pivoted to an opened position. Conveyor 60 is associated with the fuser to transport support material 34 from transfer roll 36 thereto. Conveyor 60 comprises a plurality of endless belts 62 entrained about a pair of opposed, spaced rollers 64. A vacuum system maintains a low pressure by drawing air through apertures 66 in belt 62 to tack support material 34 thereto. Leaf switch 68 detects the presence of support material 34 on belt 62 and indicates that support material 34 has been stripped properly from bias roll 36 without causing a machine jam. A suitable timing disc (not shown), mounted on drum 10 and adapted to rotate, therewith cooperates with the machine logic to actuate fuser 38 when sheet 34 passes therein. Fuser 38 is mounted slidably in the electrophotographic printing machine, i.e. it is mounted on a pair of spaced slides 70 and 82 affixed to the frame of the machine. This permits the removal of the fuser and the repair or replacement thereof.

As depicted in FIG. 2, fuser 38 includes a cover member 74 pivoted to the opened position to show more clearly lower housing member 76. Cover member 74 includes radiant energy source 78 which will be described in greater detail with reference to FIG. 4. Handle 81 is adapted to pivot cover 74 from the open position, as shown in FIG. 2, to the closed position of FIG. 3. Latch 80 disengages fuser 38 from the printing machine frame permitting the removal thereof along slides 70 and 82. Lower housing member 76 defines an open ended chamber having a pair of spaced rollers 82 and 84 mounted rotatably on transport frame 109 (FIG. 5) disposed therein. An endless belt 86 is entrained about rollers 82 and 84. Endless belt 86 includes a plurality of apertures 88 therein which are arranged to draw air therethrough such that support material 34 is tacked thereto as it passes through fuser 38. Preferably, endless belt 86 is made from an elastomeric material such as silicone rubber. However, any flexible material having high thermal resistance may be suitable.

Figure 3:
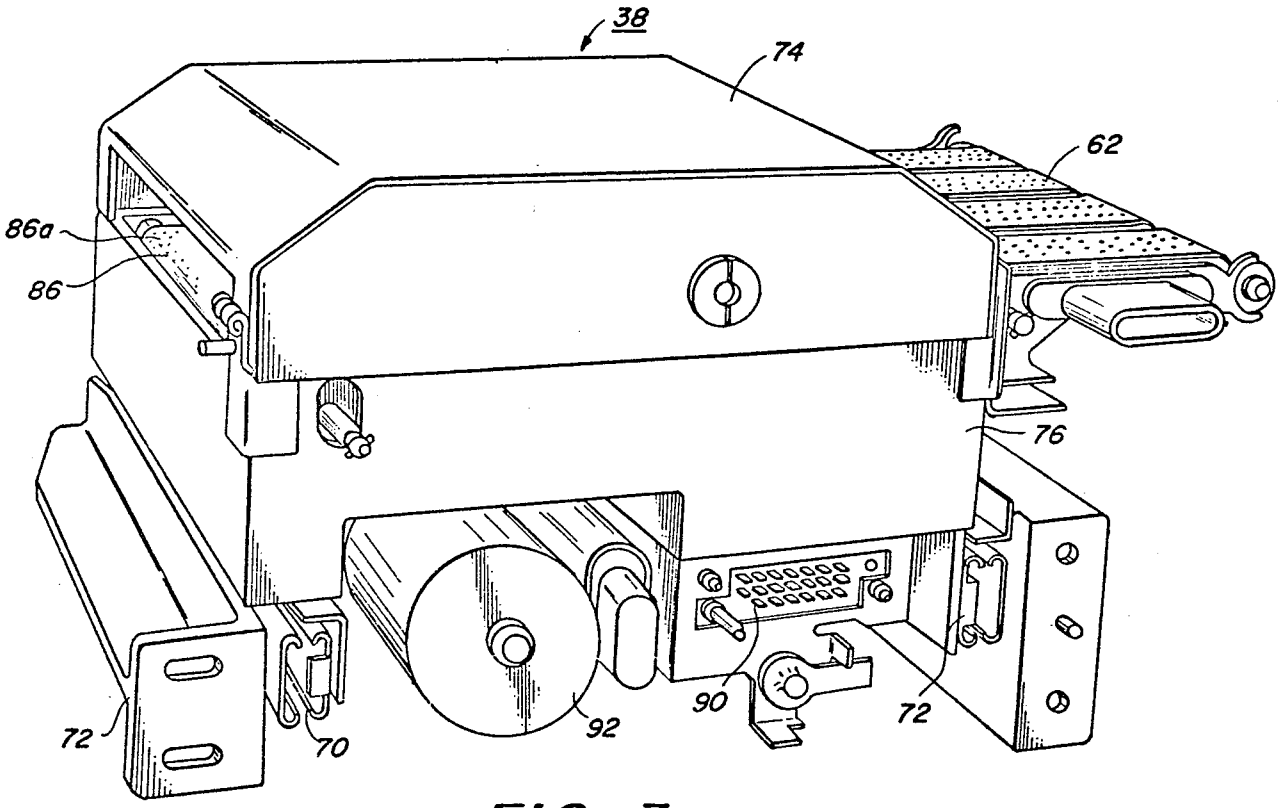
FIG. 3 is a perspective view of the FIG. 2 fuser.

Referring now to FIG. 3, there is shown fuser 38 with cover member 74 in the closed position. As illustrated therein, cover member 74 is pivoted in the closed position. When closed, cover member 74 in conjunction with lower housing member 76, defines a passage way through fuser 38 permitting endless belts 62 and 86 to move support material 34 therethrough. Fuser 38 includes a male connector 90 adapted to mate with a female connector (not shown) mounted on the frame of the printing machine. This enables fuser 38 to readily be removed from the machine and re-installed therein without connecting electrical wires, i.e. fuser 38 moves along slides 72 and 74 until connector 90 mates with the female connector mounted on the machine frame. This electrically connects the fuser to the power supply placing it in an operable mode. Air removing means or blower motor 92 is operatively associated with fuser 38 to maintain a suitable pressure differential tacking support material 34 to the exterior surface **86*a* of endless belt 86. In addition thereto, the air passing through endless belt 86 is heated. The heating means will be described hereinafter in conjunction with FIGS. 5 and 6. Preferably, blower motor 92** is a two-pole split-capacitor motor.

Figure 4:
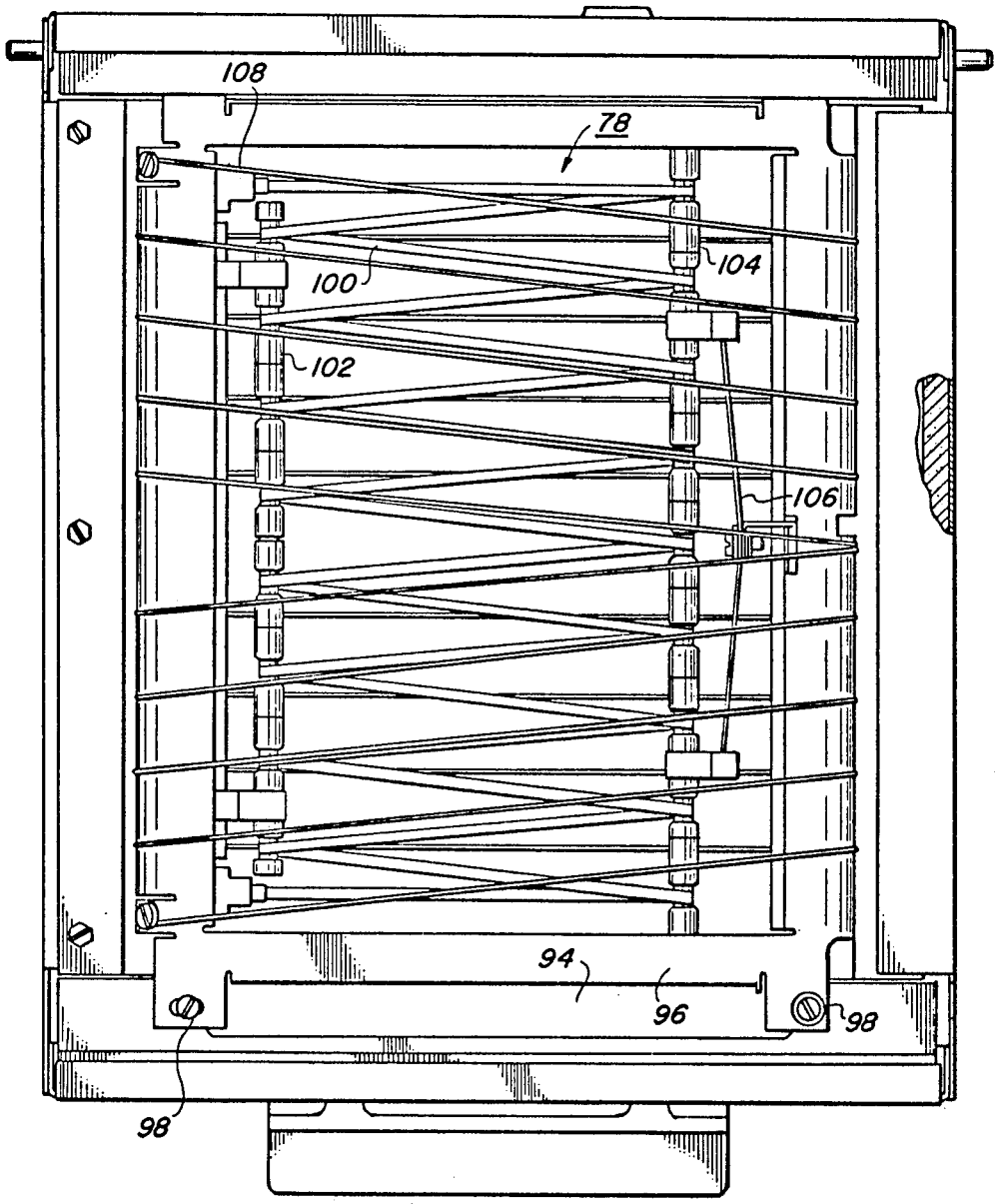
FIG. 4 is a plan view of the cover utilized in the FIG. 2 fuser.

Turning now to FIG. 4, there is shown a planar view of cover member 74. Preferably, cover member 74 includes a metal shell having secdured to the interior surface thereof suitable insulation. A silicon rubber coating is sprayed on the exterior surface of cover 74 to protect the operator. An outer reflector 94 is suitably secured to the insulation. An inner reflector 96 is mounted to the outer reflector via a pair of screws 98. Both reflectors 94 and 96, preferably, are made from aluminum having a reflectivity of approximately 95 percent. Air circulates between inner reflector 96 and outer reflector 94. Sensing means or a thermistor is positioned in the air space between inner reflector 96 and outer reflector 94 to measure the temperature thereat. One type of suitable thermistor for detecting the temperature in the air space between outer reflector 94 and inner reflector 96 is a glass bead thermistor.

The radiant energy source or radiant heat strip 78 is a nickel chromium alloy ribbon 100 entrained helically between a pair of spaced opposed support members such as ceramic spool assemblies 102 and 104, respectively. The arrangement of heat strips 78 is such as to provide substantially uniform radiation therefrom. Heat strips 78 are of a low thermal mass, preferably, being made from a nickel chromium alloy, and have the end elements thereof arranged to prevent radiation fall off. Ceramic spool 102 is mounted fixedly to cover 74. Ceramic spool 104 is mounted to a leaf spring arrangement 106 which, in turn, is mounted fixedly on cover 74. Leaf spring 106 is made from a high temperature steel and is adapted to permit the distance between ceramic spools 104 and 102 to vary as a function of the thermal expansion of nickel chromium alloy ribbon 100. A suitable guide, preferably wire 108, is wound over energy source 78 and arranged to prevent support material 34 from engaging the heating elements or nichrome ribbon 100. Guide 108 may be made from nichrome wire, fiberglass string, or, preferably, from quartz string.

Figure 5:
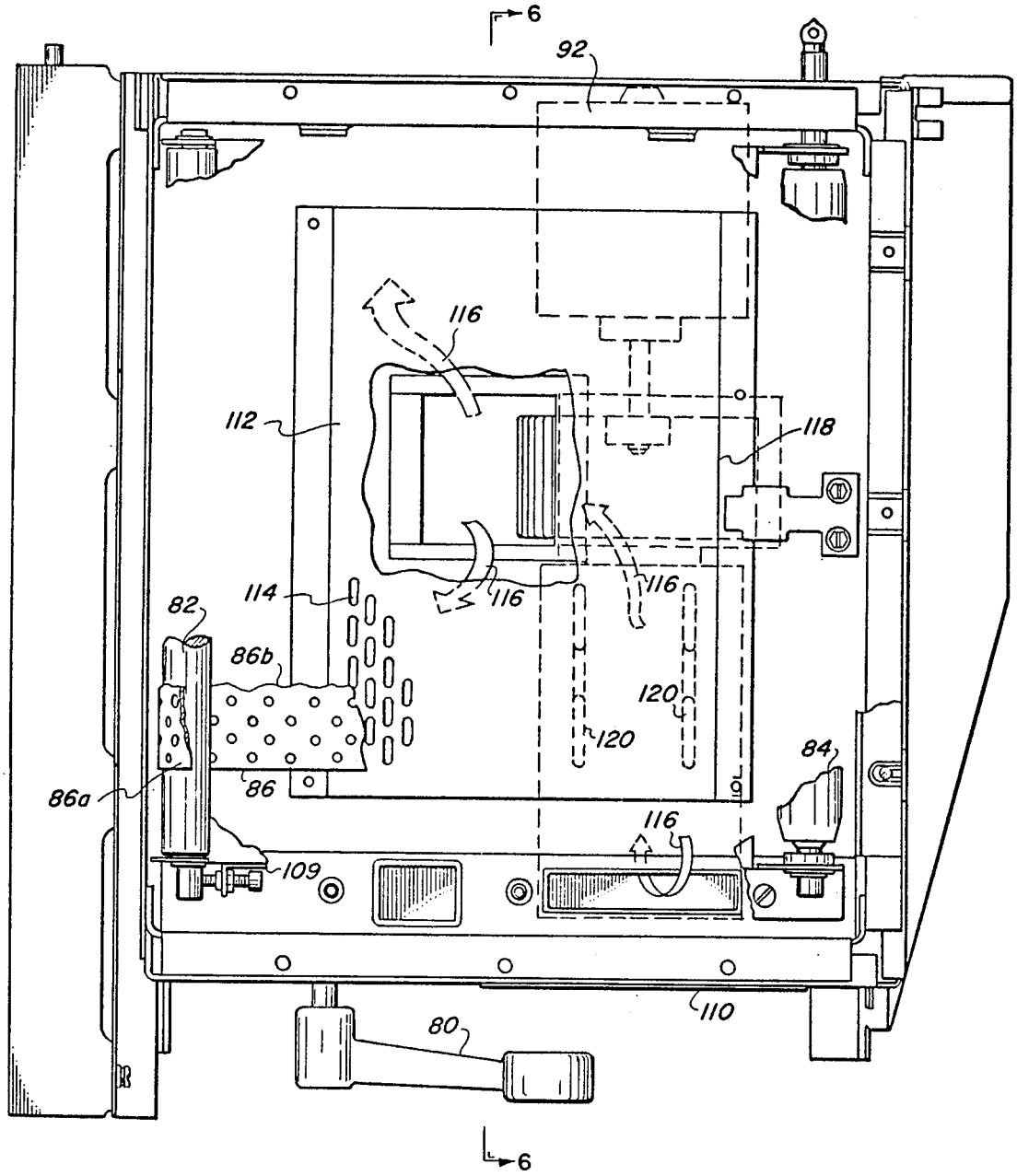
FIG. 5 is a plan view of the FIG. 2 fuser bottom housing.

Turning now to FIG. 5, there is shown a plan view of lower housing assembly 76. Lower housing 76 includes a sheet metal shell 110 having insulation secured to the interior surface thereof. Transport frame 109 is mounted removably in shell 110. Rollers 82 and 84 are rotatably mounted on frame 109 and have entrained thereabout endless belt 86. Interior surface **86*b* of endless belt 86 is adapted to engage plate member 112. Plate member 112 includes a plurality of apertures or slots 114 therein adapted to permit the flow of air therethrough in the direction of arrows 116. Blower member 92 has vane member 118 mounted thereon and is adapted to rotate vane member 118 such that air flows in the direction of arrows 116. The air flow passes over heating means or auxiliary heater 120 onto plate member 112 raising its temperature. Plate member 112 engages the undersurface 86*b* of endless belt 86 and conducts heat thereto. This, in turn, raises the temperature of support member 34 minimizing any heat loss thereto. In this manner, radiant energy from elements 100, in conjunction with the heated support material 34** coalesces the multi-layered toner powder image formed thereon.

Figure 6:
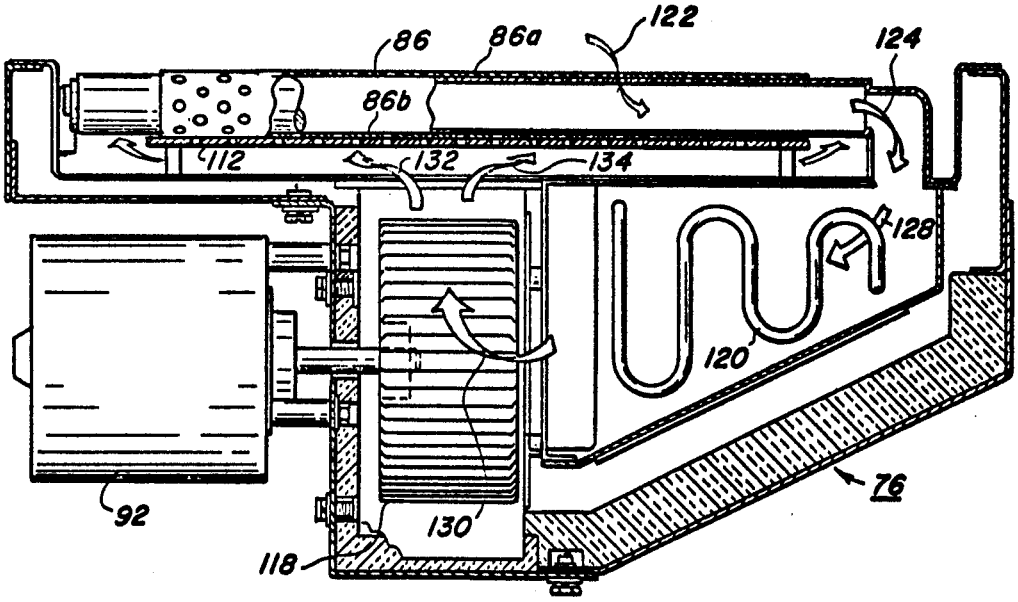
FIG. 6 is a sectional elevational view taken along the line 6—6 of FIG. 5 in the direction of the arrows.

Referring now to FIG. 6, there is shown a sectional elevational view of the air flow in lower housing 76. As shown therein, air moves downwardly through the exterior surface **86*a* of endless belt 86 in the direction of arrow 122. It passes through the opened ends of endless belt 86 as indicated by arrow 124 and over the resistance heating elements 126 of heating means 120 as indicated by arrow 128. It is drawn into vane member 118 as shown by arrow 130, and propelled therefrom, as indicated by arrows 132 and 134, onto plate member 112 contacting interior surface 86*b* of endless belt 86. Heating means 120 is, preferably, a 800 watt tubular high mass heater. Sensing means or a cam enclosed bead thermistor (not shown) is arranged to detect the temperature of endless belt 86. The thermistor is mounted on a thermally conductive shoe which, in turn, is arranged to contact the lower surface 86*b* of belt 86**.

The control means for heating means 120 is, preferably, a time proportional, zero cross-over controller whose function is to maintain the temperature of endless belt 86 at a prescribed standby temperature. Temperature control is achieved through thermistor feedback. The belt thermistor measures the actual temperature of belt 86 and suitable comparator circuits compare the sensed temperature with a reference corresponding to the desired standby temperature. The comparator circuits develop an error signal for actuating heating means 120. In this way, endless belt 86 is maintained at a desired standby temperature. The radiant energy source controller provides the control for radiant heat strip 78. It furnishes two distinct power levels, i.e. 1750 watts and 1250 watts, which are dependent upon the air temperature between outer reflector 94 and inner reflector 96. As mentioned previously, the thermistor positioned thereat detects the temperature in the air space therebetween. Preferably, the switch point is about 450° F. Thus, if the thermistor positioned in the air space between inner and outer reflectors 96 and 94, respectively, indicates a temperature greater than 450° F switching means changes the power input to radiant strips 78 from about 1750 watts to about 1250 watts. If the thermistor indicates a temperature less than 450° F, the power input to radiant strips 78 switches from about 1250 watts to about 1750 watts. This is achieved by suitable comparator circuits which compare the measured temperature, as indicated by the thermistor in the air space therebetween, with a reference. The difference is an error signal which is utilized to control radiant strips 78. The foregoing type of control arrangement is utilized to maintain the total radiation impinging the powder image substantially constant. It is evident that as the temperature of both reflectors increases, the radiation emitted therefrom also increases. Thus, in order to maintain the total emitted radiation substantially constant, it is necessary to reduce the radiation emitted from heat strip 78. This is accomplished by reducing the power furnished to heat strip 78 from about 1750 watts to about 1250 watts.

In operation, the electrophotographic printing machine is turned on and heated from a cold condition to a standby condition. During the warm up phase both heating means 120 and radiant energy source 78 are activated. Initially radiant energy source 78 operates at a full power of 1750 watts. When endless belt 86 is raised to a preselected standby temperature which may range from about 390° to about 420° F, depending upon humidity conditions, radiant energy source 78 is turned off. Fuser 38 is maintained at the standby temperature by heating means 120. When a sheet of support material enters the fuser the machine logic energizes radiant energy source 78 at the upper power level (in this case 1750 watts), and de-energizes heater 120. As the sheet of support material leaves the fuser, the machine control logic energizes heater 120 and de-energizes radant energy source 78. The preceding control scheme continues if the thermistor positioned in the air space between outer reflector 94 and inner reflector 96 indicates a temperature below about 450° F. If, however, the temperature exceeds about 450° F, radiant energy source 78 is energized at a lower power level (in this case 1250 watts) when a sheet of support material enters the fuser. In addition thereto, heater 120 is energized substantially simultaneously with radiant energy source 78. As the sheet of support material leaves the fuser, the machine control logic de-energizes radiant energy source 78, while heater 120 remains energized. Furthermore, in the event that a transparency material such as a coated thermoplastic material rather than a paper is passing through the fuser, energy source 78 is inactivated and heating means 120 is activated. Thus, it is apparent that the aforementioned fuser and the associate control mechanism maintain the support material and the environment surrounding the multi-layered toner material at a sufficient temperature to coalesce the powder image without igniting or charring the support material. Therefore, it is apparent that the fusing apparatus of the present invention coalesce a multi-layered toner powder image creating a composite color reproduction corresponding to the original colored document.

In recapitulation, sequential color separated electrostatic latent images are formed on a photoconductive surface and sequentially developed by the respective colored toner particles complementing the color separated latent image. The developed toner powder image is transferred to a sheet of support material. This process is repeated a plurality of times forming a multi-layered (in this case a three layered) toner powder image wherein each layer of toner powder is of a distinctly different color from the prior layer. The layers of toner powder are coalesced in the fuser of the present invention forming a composite multi-color reproduction affixed to a support material.

Thus, it is apparent that there has been provided, in accordance with this invention, a fusing apparatus that fully satisfies the objects, aims and advantages set forth above. While the invention has been described in conjunction with a specific embodiment and method of use thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A method of electrophotographic printing including the steps of:

charging a photoconductive surface to a substantially uniform potential;

projecting a light image of an original document to be reproduced onto the photoconducive surface to record an electrostatic latent image thereon;

developing the electrostatic latent image with toner particles to create a toner powder image adhering electrostatically to the photoconductive surface;

transferring the toner powder image from the photoconductive surface to a sheet of support material;

transporting the sheet of support material with the toner powder image deposited on one surface thereof along a path of movement on an endless belt arranged to be in substantial contact with the other surface of the support material;

heating the surface of the endless belt contacting the support material;

energizing a radiant energy supply in response to a sheet of support material being positioned on the endless belt; and controlling the radiant energy supply at a lower power level above a predetermined temperature, and a higher power level below the predetermined temperature.

2. A method as recited in claim 1, wherein said step of controlling the radiant energy supply includes the steps of:

sensing the temperature in the region of the radiant energy supply;

generating an electrical output signal corresponding to the sensed temperature;

developing a reference corresponding to the predetermined temperature;

comparing the electrical output signal with the reference to form an electrical error signal indicative of the difference therebetween; and switching the radiant energy supply to the lower power level from the higher power level in response to the electrical error signal indicating the temperature in the region of the radiant energy supply being above the predetermined temperature.

3. A method as recited in claim 2, further including the steps of:

sensing the temperature in the region of the endless belt;

generating an electrical output signal corresponding to the sensed temperature;

developing a reference corresponding to a preselected temperature;

comparing the reference with the electrical output signal to form an electrical error signal indicative of the difference therebetween; and controlling said step of heating the endless belt in response to the electrical error signal.

* * * * *